US007367168B2

(12) United States Patent
Lin

(10) Patent No.: US 7,367,168 B2
(45) Date of Patent: May 6, 2008

(54) SKEWED GIRDER TIE

(75) Inventor: Jin-Jie Lin, Livermore, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 421 days.

(21) Appl. No.: 11/217,940

(22) Filed: Aug. 31, 2005

(65) Prior Publication Data

US 2007/0044420 A1 Mar. 1, 2007

(51) Int. Cl.
*E04C 5/00* (2006.01)

(52) U.S. Cl. ..... 52/702; 52/712

(58) Field of Classification Search ..... 52/702, 52/715, 712, 655.1, 289; 403/291; 16/225; 248/300

See application file for complete search history.

(56) References Cited

U.S. PATENT DOCUMENTS 3,423,898 A * 1/1969 Coloney et al. ..... 52/713
4,230,416 A * 10/1980 Gilb ..... 403/232.1
4,261,155 A * 4/1981 Gilb ..... 52/702
4,423,977 A * 1/1984 Gilb ..... 403/232.1
4,817,359 A 4/1989 Colonias
4,890,436 A 1/1990 Colonias
4,897,979 A 2/1990 Colonias
5,042,217 A 8/1991 Bugbee et al.
5,220,766 A * 6/1993 Hills, Sr. ..... 52/702
5,240,342 A * 8/1993 Kresa, Jr. ..... 403/232.1
5,253,465 A * 10/1993 Gilb ..... 52/643
5,341,619 A * 8/1994 Dunagan et al. ..... 52/702
5,598,680 A 2/1997 Wilhelmi
5,670,076 A 9/1997 Leek
5,732,519 A 3/1998 Leek
5,857,295 A * 1/1999 Mikawa ..... 52/92.2
6,230,467 B1 * 5/2001 Leek ..... 52/702
6,254,306 B1 7/2001 Williams
6,840,020 B2 1/2005 Leek et al.
2003/0079433 A1 * 5/2003 Leek et al. ..... 52/712
2004/0079044 A1 4/2004 Troth et al.

OTHER PUBLICATIONS

Nuconsteel A Nucor Company. "Nutruss, "http://nuconsteel.com//pages/projects—nutruss —overview.html (2005) Nuconsteel.
Simpson Strong-Tie Company, Inc., "LTHJA26 Truss Hip/Jack Girders," http://www.strongtie.com/products/connectors/LTHJA26—PT.html (2005) Simpson Strong-Tie Company, Inc. USA.
Simpson Strong-Tie Company, Inc., "TJC37 Jack Truss Connector," (2005) Simpson Strong-Tie Company, Inc., USA.

(Continued)

*Primary Examiner*—Richard E. Chilcot, Jr.
*Assistant Examiner*—Anthony N. Bartosik
(74) *Attorney, Agent, or Firm*—Charles R. Cypher; James R. Cypher

(57) ABSTRACT

A connector for joining a supported member to a supporting member is formed with a series of angularly-joined flanges. The flanges are substantially planar and are substantially vertically oriented, when joining the supported member to the supporting member. The connector allows the end of a supported truss to be connected to a vertical member in the open web of a supporting truss.

23 Claims, 10 Drawing Sheets

OTHER PUBLICATIONS

Thallon, Rob, "Graphic Guide to Frame Construction." (Framing) p. 130. (Valley Framing with Trusses) p. 150, (1992) The Taunton Press, Newton, CT.

Tanaka Steel, item No. 60, pp. 52, 20,000 (J), (Jul. 1996).

Simpson Strong-Tie Company , Inc., "Wood Construction Connectors," Catalog C-2003, pp. 60, 61, 63, 94, 95, 96, 104, 105, 109, 110, 110, 111, 112, 132, 133, 135, 142, 143, 148, 149, 150 and 151, (C-2003), Simpson Strong-Tie Company, Inc. USA.

* cited by examiner

SKEWED GIRDER TIE

BACKGROUND

This invention relates to a connector for joining structural members. The connector of the present invention has particular application as a sheet metal hanger for use in a hip roof, joining supported hip trusses to supporting girder trusses or supported jack trusses to supporting hip trusses. A hip roof is sloped ends as well as sloped sides. The roof rises by inclining planes from all four sides of the building of which it is a part. The line where an adjacent sloping side and sloping end meet is generally called the "hip." The four hips generally run from a corner of the building to the peak of the roof at a 45 degree angle. The hips are not merely lines, but are either rafters or trusses. The ends of the roof can be built up from flat-topped trusses that step down from the roof ridge. The ends of the roof can be made from sloping jack trusses that run parallel to the roof peak and which are supported at and by the end wall of the building and by a girder truss. The ends of the roof can also be made with a combination of stepped-down flat-topped trusses and jack trusses, in which case the flat-topped truss closest to the end wall is the girder truss supporting the jack trusses. Generally, any truss that does not span from wall to wall is referred to as a jack truss, so the truss on the hip line could be referred to as a jack truss. However, for the sake of clarity, the truss on the hip line will be referred to as a hip truss in the present application. In addition to the jack trusses that run parallel to the roof ridge and are supported by a girder truss, there generally are shorter jack trusses that are supported by the hip trusses where the hip trusses approach the corners of the roof and building.

In the particular application for joining multiple members, the framing members may be lumber or wood trusses, but in the most preferred form the framing members are hollow steel trusses. The connection is most typically made at the junction of the supporting girder truss and one hip truss framing member.

Prior art U.S. Pat. No. 5,253,465, granted to Tyrell T. Gilb teaches a sheet metal connector for making multiple truss connections. U.S. Pat. No. 4,817,359, granted to Karen Colonias also teaches a similar connection with a sheet metal hanger; however, neither of these patents teach the improved connector of the present invention.

SUMMARY OF THE INVENTION

The improved connector of the present invention provides a connector with a series of angularly-joined flanges, that in the most preferred embodiments are substantially planar, the planes being vertically oriented in the connection. The connector allows the end of a supported truss to be connected to a vertical member in the open web of a supporting truss, the formed connection being skewed, most preferably at a 45 degree angle. The flanges and the junctures between them are both reinforced by lateral embossments or gussets that span the junctures from flange to flange. The reinforcements bolster the junctures so that the angles between the flanges remain fixed and the flanges are reinforced against deformation so that they remain generally planar.

When the connector is formed from a sheet metal blank that is bent and formed into its final configuration, the embossments are created while the blank is still flat, after which the flanges are bent out of the blank, creating the junctures between them. The upper threshold of the embossments in terms of reinforcing the junctures between the flanges is therefore the amount of force used to create the flanges and junctures.

The connector of the present invention is specifically designed to join a left or right hip truss to a supporting girder truss that has an open web.

An advantage of the present invention is that it better joins hollow metal members because it fastens to each of the supporting and supported members with fasteners that are perpendicular to each other and therefore cannot move together in the same plane under shear loads.

An advantage of the present invention is that it is economically formed formed from a substantially rectangular blank that wastes virtually no material in the manufacturing process.

DESCRIPTION OF THE PREFERRED EMBODIMENTS OF THE INVENTION

Figure 1:
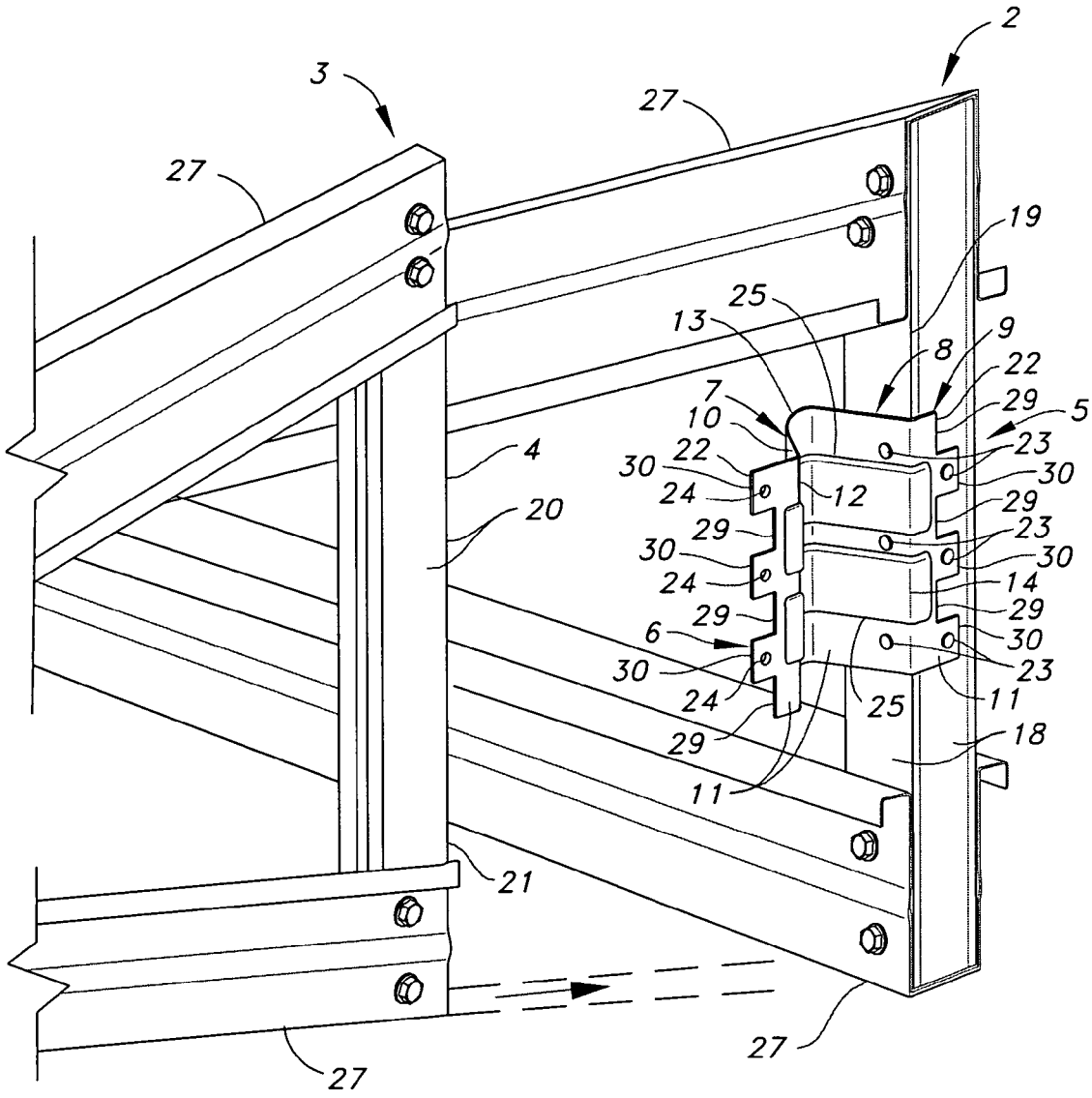
FIG. 1 is a perspective view of the present invention used as a hip truss to girder truss connector.

In its most basic form, the connector 5 of the present invention comprises four flanges 6, 7, 8 and 9 sequentially joined at three angles 15, 16 and 17 to each other at three bends 12, 13 and 14. The four flanges 6, 7, 8 and 9 are preferably flat, or nearly so, are generally rectangular, and each have two sides, an interface side 10 and an open side 11. The interface side 10 is adapted to interface with a structural member, while the open side does not. The second flange 7 is integrally joined to the first flange 6 at a first bend 12, the third flange 8 is integrally joined to the second flange 7 at a second bend 13, and the fourth flange 9 is integrally joined to the third flange 8 at a third bend 14. The first and fourth flanges 6 and 9 have open edges 22 opposite the first and third bends 12 and 14 respectively. In the most preferred embodiments, the open edges 22 are 4" long when straight, and span 4" if they are not straight. The distance between the open edges 22 is most preferably 5.4375" when the connector 5 is still a flat blank.

Preferably, the first angle 15 between the interface side 10 of the first flange 6 and the interface side 10 of the second flange 7 is a right angle. The second angle 16 between the open side 11 of the second flange 7 and the open side 11 of the third flange is preferably 45 degrees. The third angle 17 between the interface side 10 of the third flange 8 and the interface side 10 of the fourth flange 9 is preferably a right angle. Thus, the connector 5 when viewed from above or below has a W-shaped profile.

Preferably, the connector 5 of the present invention is formed from a single piece of sheet metal, preferably steel. The steel preferably has a galvanized coating, preferably at least G90, which is a minimum of 0.90 ounce of zinc per square foot of surface area. Heavier galvanized coatings are also possible, including hot-dip galvanized, which is a minimum of 2.0 ounces of zinc per square foot of surface area. Heavier galvanized coating generally demand the use of hot-dip galvanized fasteners 23. The connector 5 can also be made from stainless steel, preferably type 316L, which requires the use of stainless steel fasteners 23. If the connector 5 is made from sheet metal, the outline is preferably cut, fastener openings 24 are punched, reinforcing embossments 25 or gussets 26 are formed, and the flanges 6, 7, 8 and 9 are then created by forming the three bends 12, 13 and 14. The connector 5 can also be cast from metals (e.g., aluminum), plastics (e.g., acrylonitrile butadiene styrene), composites (e.g., carbon fibre) or the like. If the connector 5 is cast, the bends 12, 13 and 14 would be cast rather than created by bending, but would otherwise be equivalent to bends created by bending. Similarly, the outline, fastener openings 24 and reinforcements could all be cast, rather than cut, punched and, for instance, embossed. The preferred fasteners are #10 self-drilling metal screws, a standard in the industry.

In its most basic form, the connection 1 comprises a generally horizontal, supporting structural member 2, a generally horizontal, supported structural member 3, having a substantially vertical first end 4, and the connector 5, connecting the first end 4 of the supported structural member 3 to the supporting structural member 2.

The supported structural member 3 is not parallel to the supporting structural member 2. The supported structural member 3 is not orthogonal to the supporting structural member 2. The first end 4 of the supported structural member 3 is connected to the supporting structural member 2 with a connector 5. The supported structural member 3 is supported by the supporting structural member 2.

The connector 5 has a first flange 6, a second flange 7, a third flange 8 and a fourth flange 9. The first flange 6 has an interface side 10 interfacing with the supported structural member 3 and an open side 11. The second flange 7 has an interface side 10 interfacing with the supported structural member 3 and an open side 11, the second flange 7 being integrally attached to the first flange 6 at a first bend 12. The third flange 8 has an interface side 10 interfacing with the supporting structural member 2 and an open side 11, the third flange 8 being integrally attached to the second flange 7 at a second bend 13. The fourth flange 9 has an interface side 10 interfacing with the supporting structural member 2 and an open side 11, the fourth flange 9 being integrally attached to the third flange 8 at a third bend 14.

The connector 5 has a first angle 15 between the interface side 10 of the first flange 6 and the interface side 10 of the second flange 7, and the first angle 15 is less than 180 degrees. The connector 5 has a second angle 16 between the open side 11 of the second flange 7 and the open side 11 of the third flange 8, the second angle 16 is less than 180 degrees. The connector 5 has a third angle 17 between the interface side 10 of the third flange 8 and the interface side 10 of the fourth flange 9, and the third angle 17 is less than 180 degrees.

Figure 3:
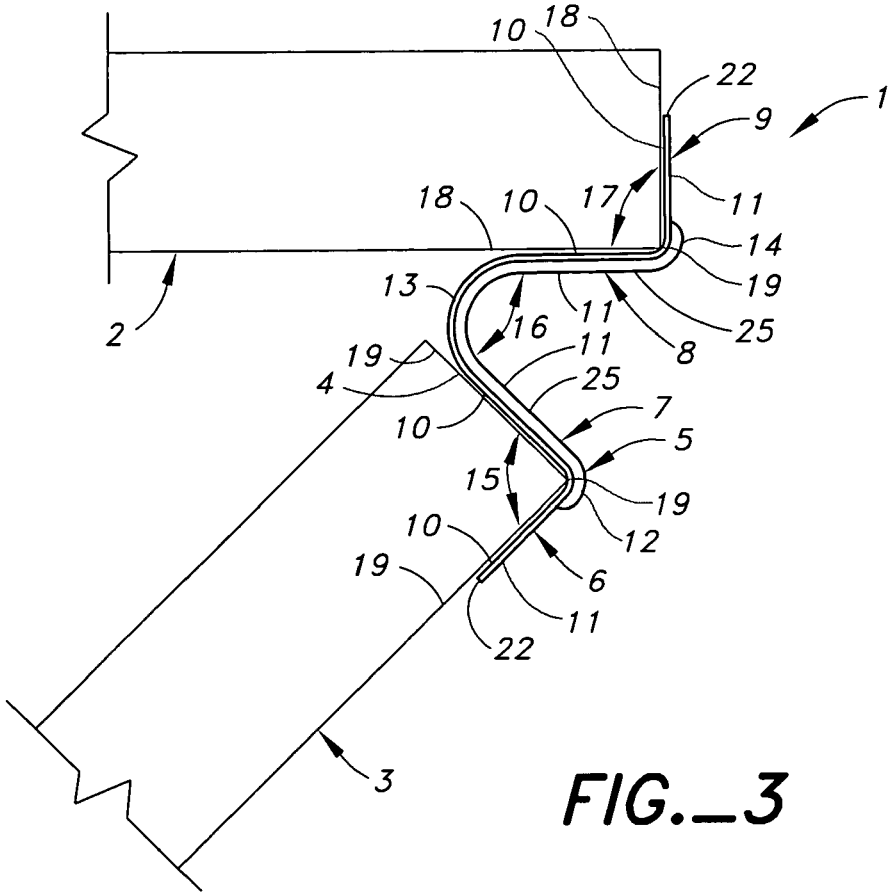
FIG. 3 is a top plan view of a portion of the hip truss to girder truss and illustrating a first hip truss and a first girder truss, both wood members, connected by a connector formed according to the present invention.
Figure 4:
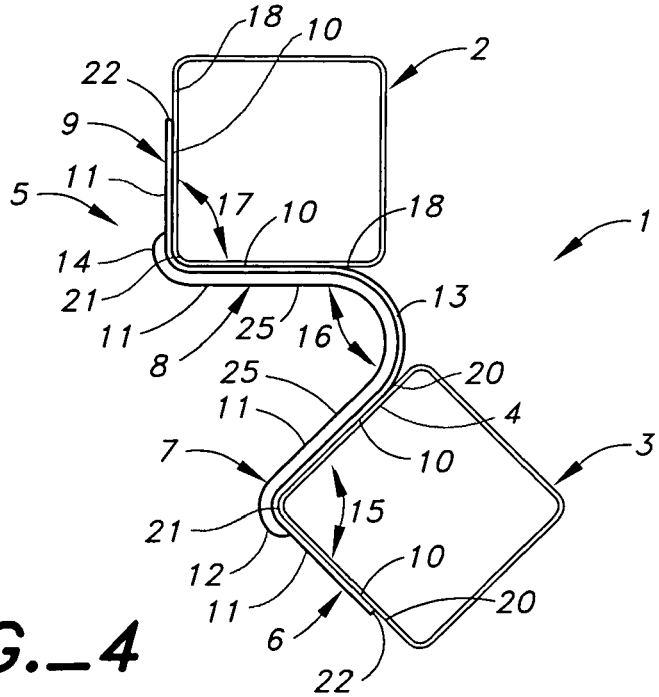
FIG. 4 is a top plan view of a portion of another hip truss to girder truss connection using a connector formed according to the present invention. The view is similar to that shown in FIG. 3 except that first hip truss is oriented to the right rather than the left, and the connected members are hollow metal members.
Figure 5:
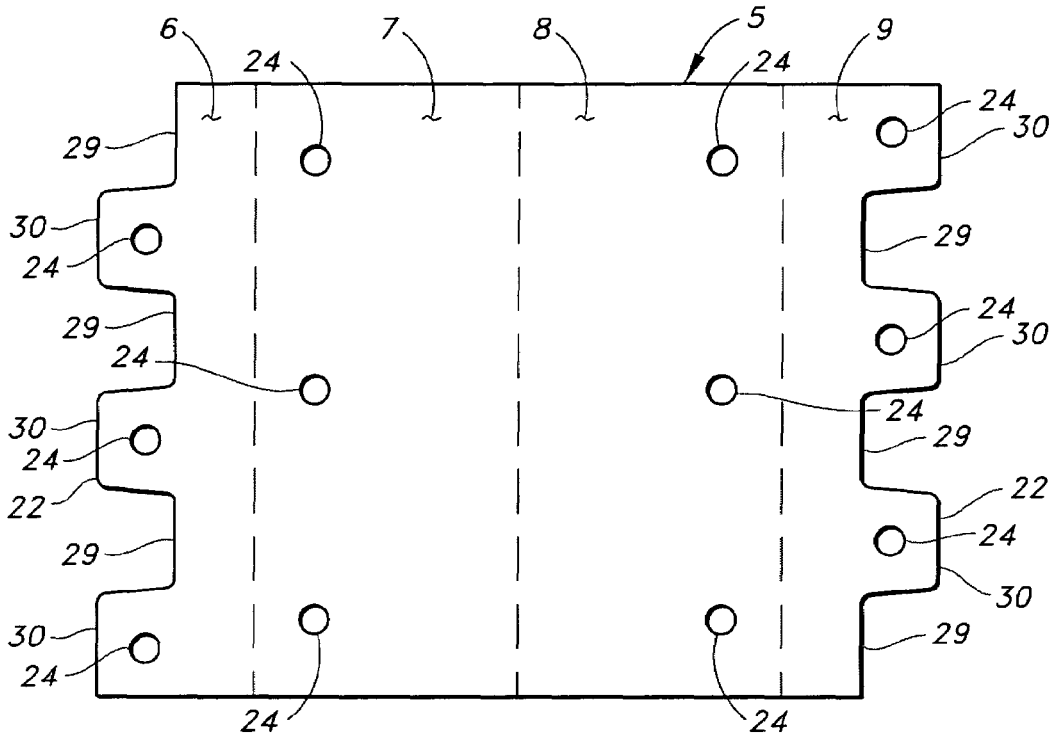
FIG. 5 is a top plan view of a sheet metal blank prior to bending from which a sheet metal connector formed according to the present invention with indentations and extensions on the outer edges is formed.
Figure 6:
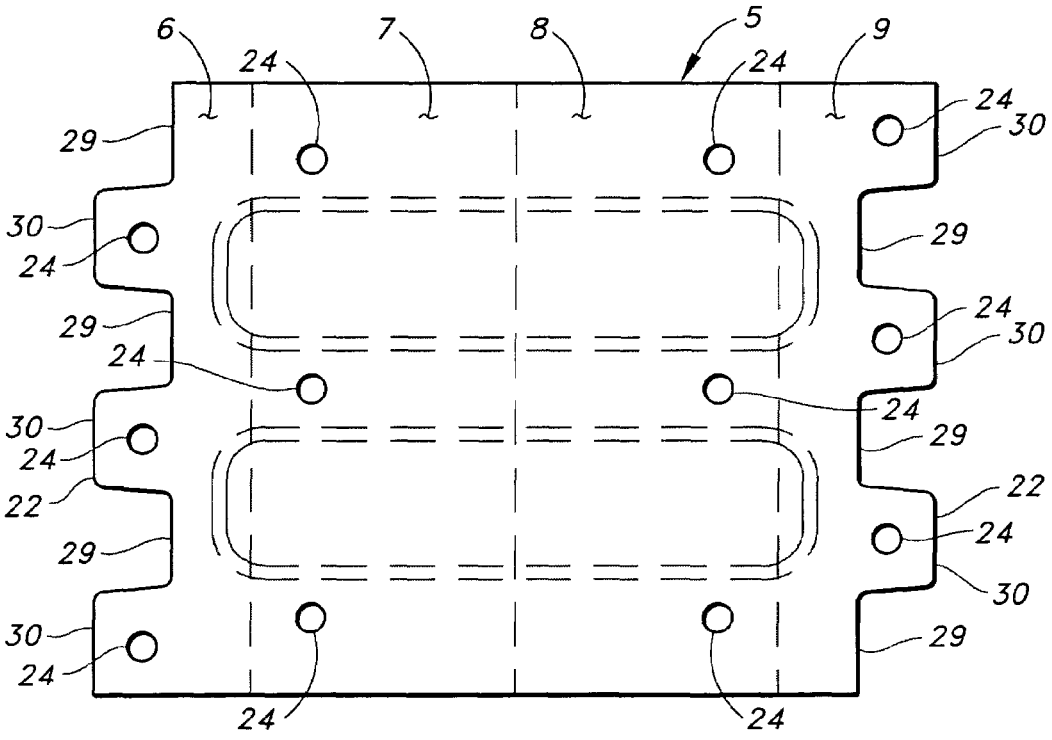
FIG. 6 is a top plan view of a sheet metal blank prior to bending from which a sheet metal connector formed according to the present invention is formed, showing where embossments will be formed in dashed outline.
Figure 7:
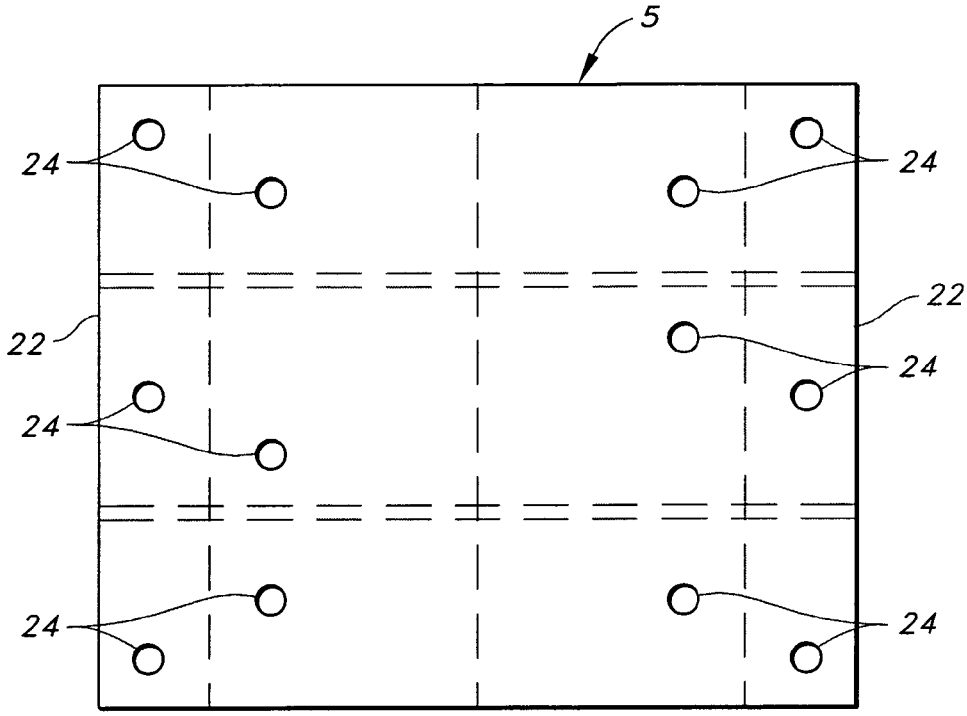
FIG. 7 is a top plan view of a sheet metal blank prior to bending from which a sheet metal connector formed according to the present invention with is formed, showing where a single large embossment will be formed in dashed outline.
Figure 8:
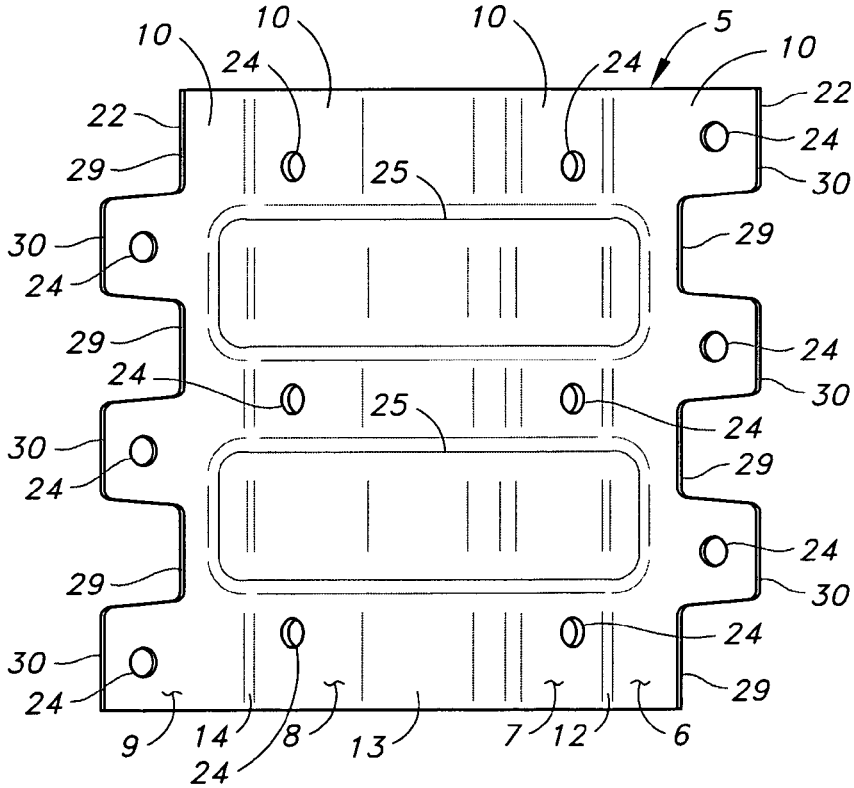
FIG. 8 is a front elevation view of a connector having reinforcing embossments and side projections formed according to the present invention.
Figure 9:
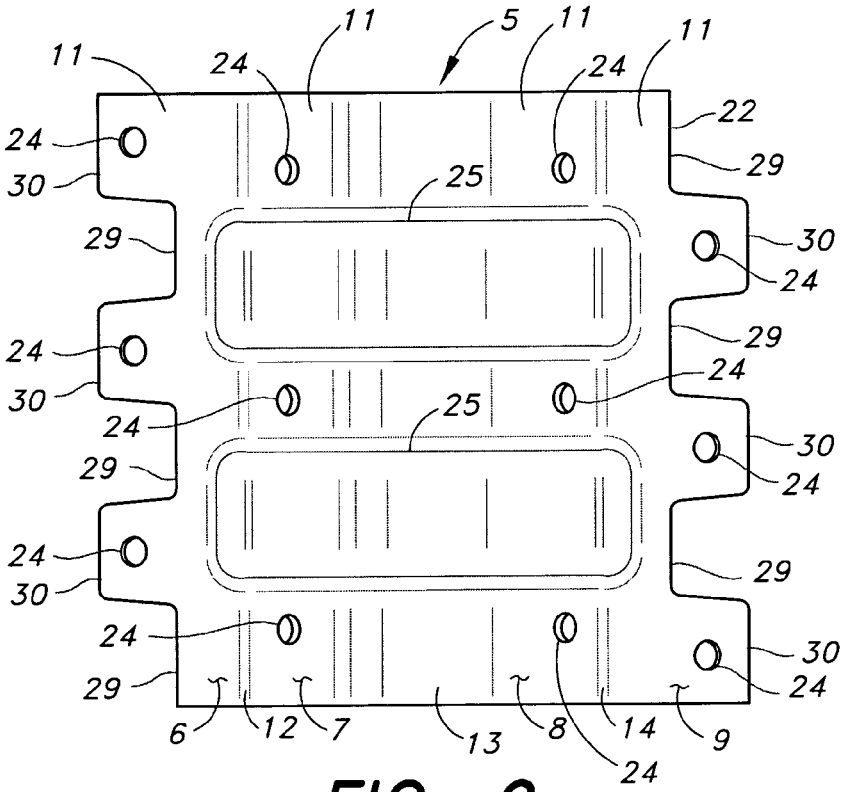
FIG. 9 is a rear elevation view of a connector having reinforcing embossments and side projections formed according to the present invention.
Figure 10:
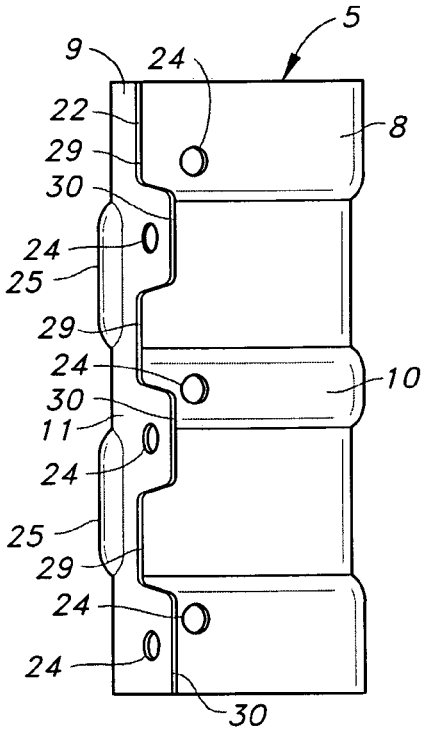
FIG. 10 is a side elevation view of a connector having reinforcing embossments formed according to the present invention.
Figure 13:
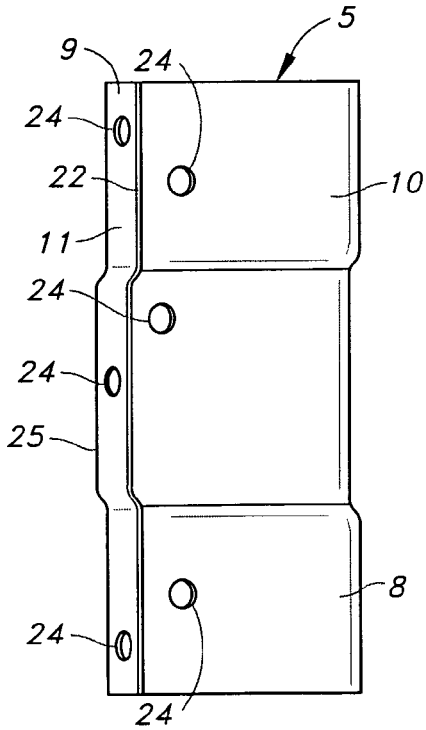
FIG. 13 is a side elevation view of a connector having a single reinforcing gusset formed according to the present invention.
Figure 11:
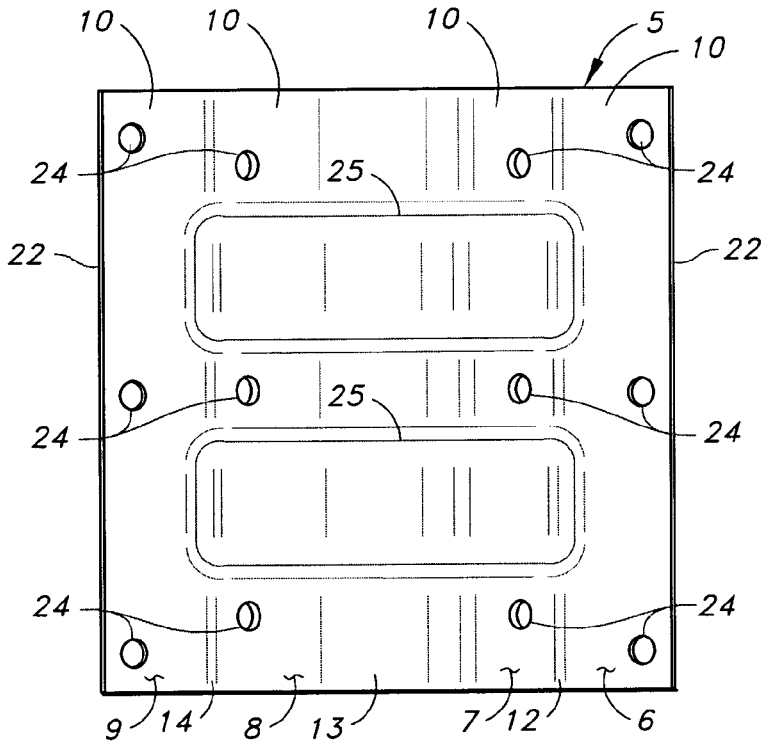
FIG. 11 is a front elevation view of a connector having reinforcing gussets and without side projections formed according to the present invention.
Figure 12:
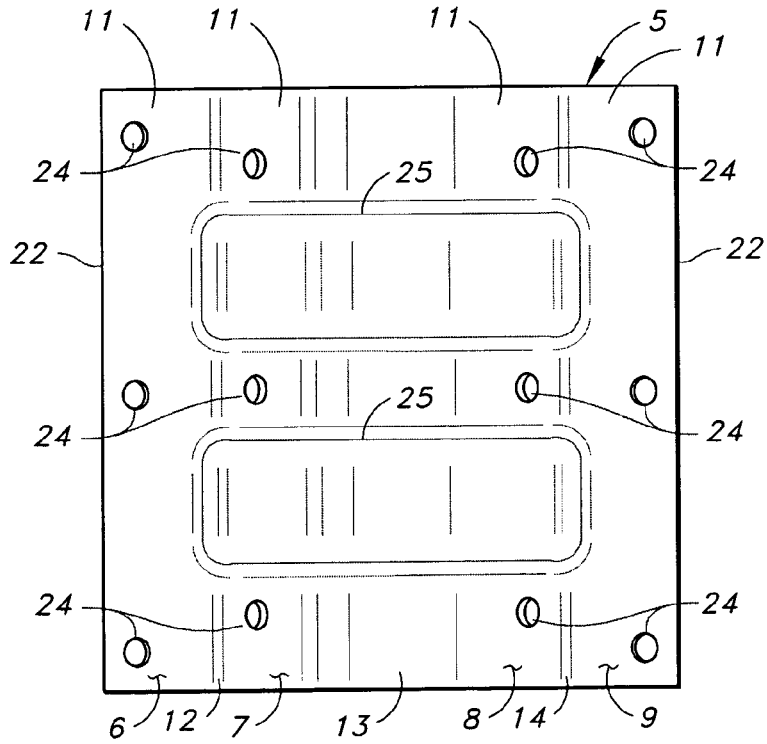
FIG. 12 is a rear elevation view of a connector having reinforcing gussets and without side projections formed according to the present invention.
Figure 14:
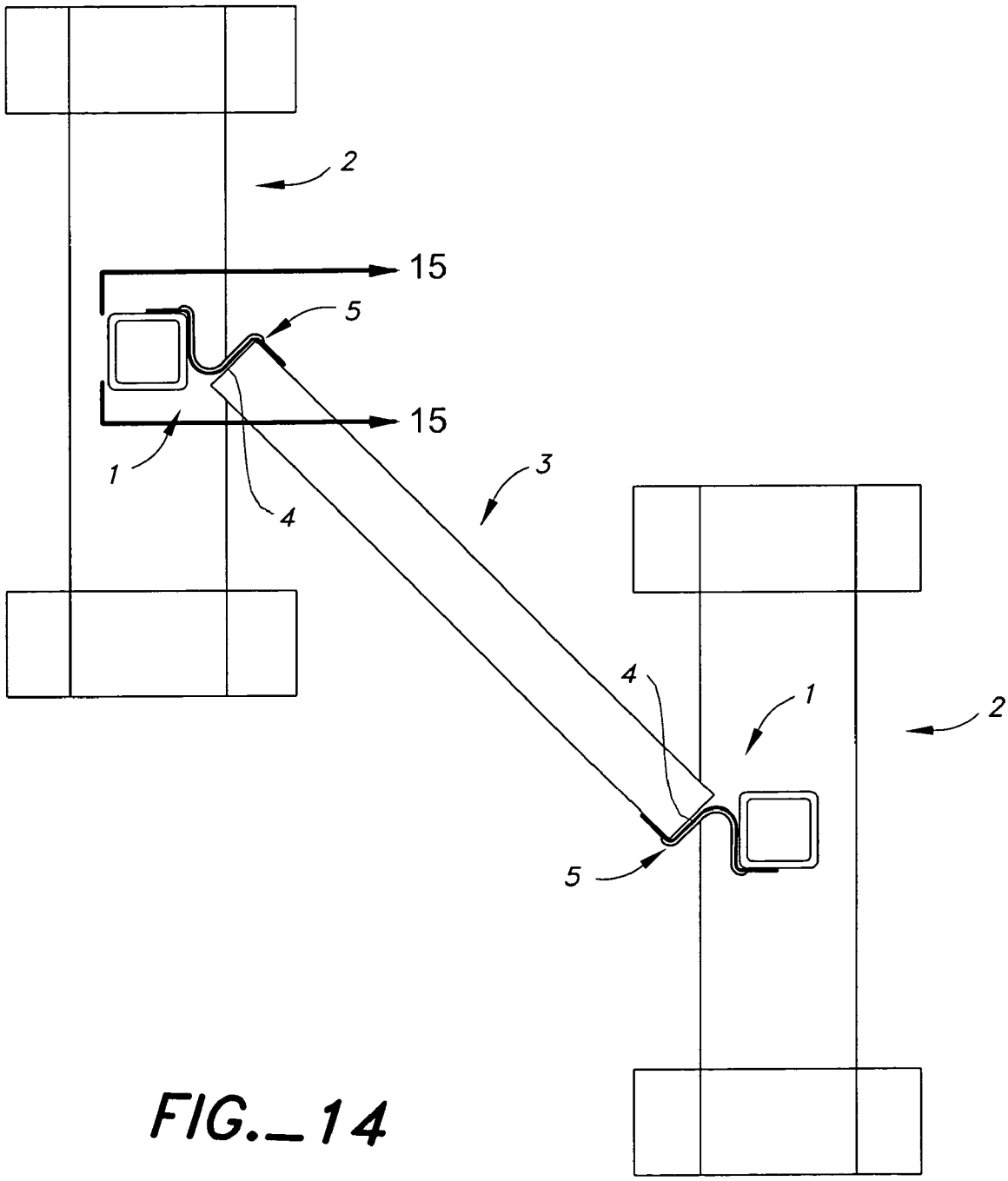
FIG. 14 is a top plan view of a small truss supported by two girder trusses, using two connectors formed according to the present invention, in which the connected members are hollow metal members.
Figure 15:
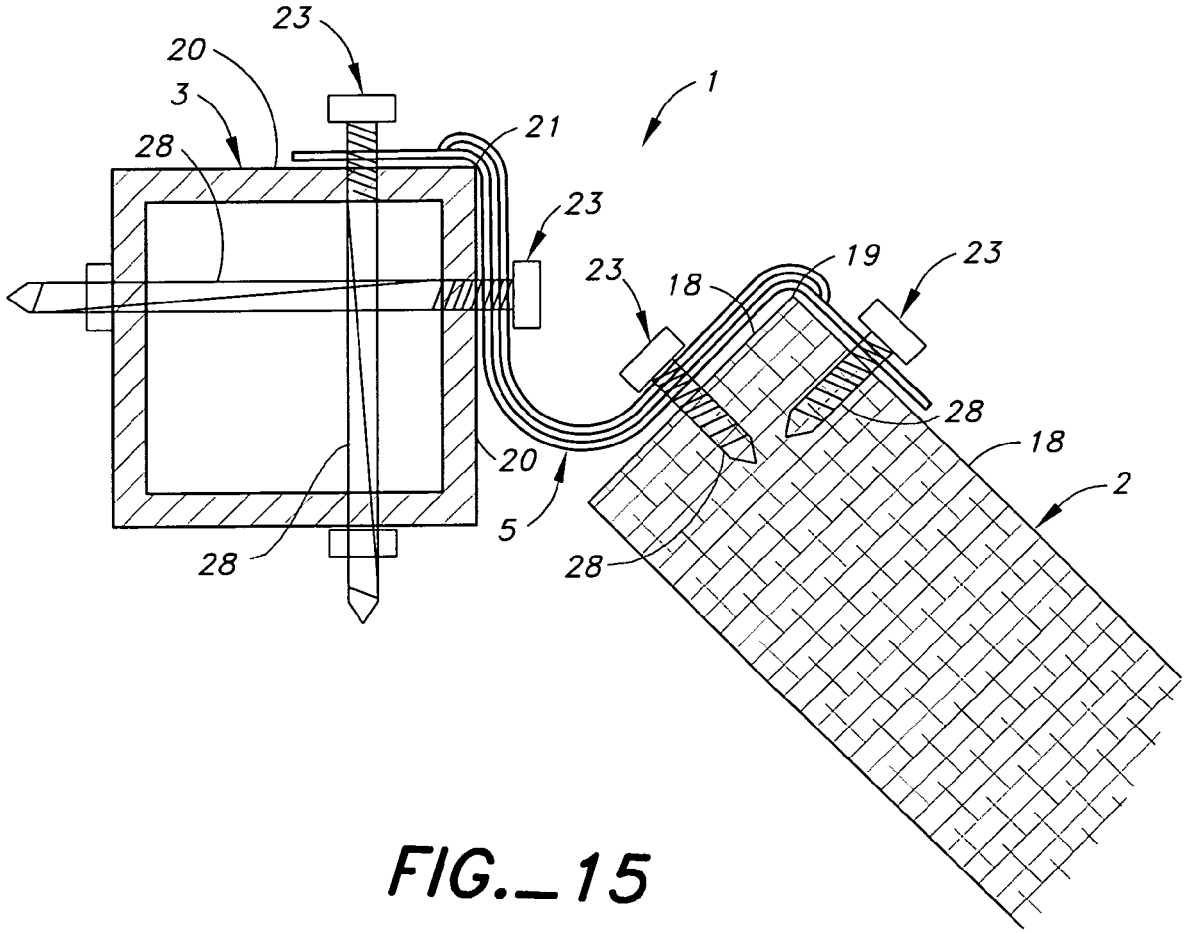
FIG. 15 is a top plan view of a portion of the hip truss to girder truss connection showing the use of the preferred fasteners.
Figure 16:
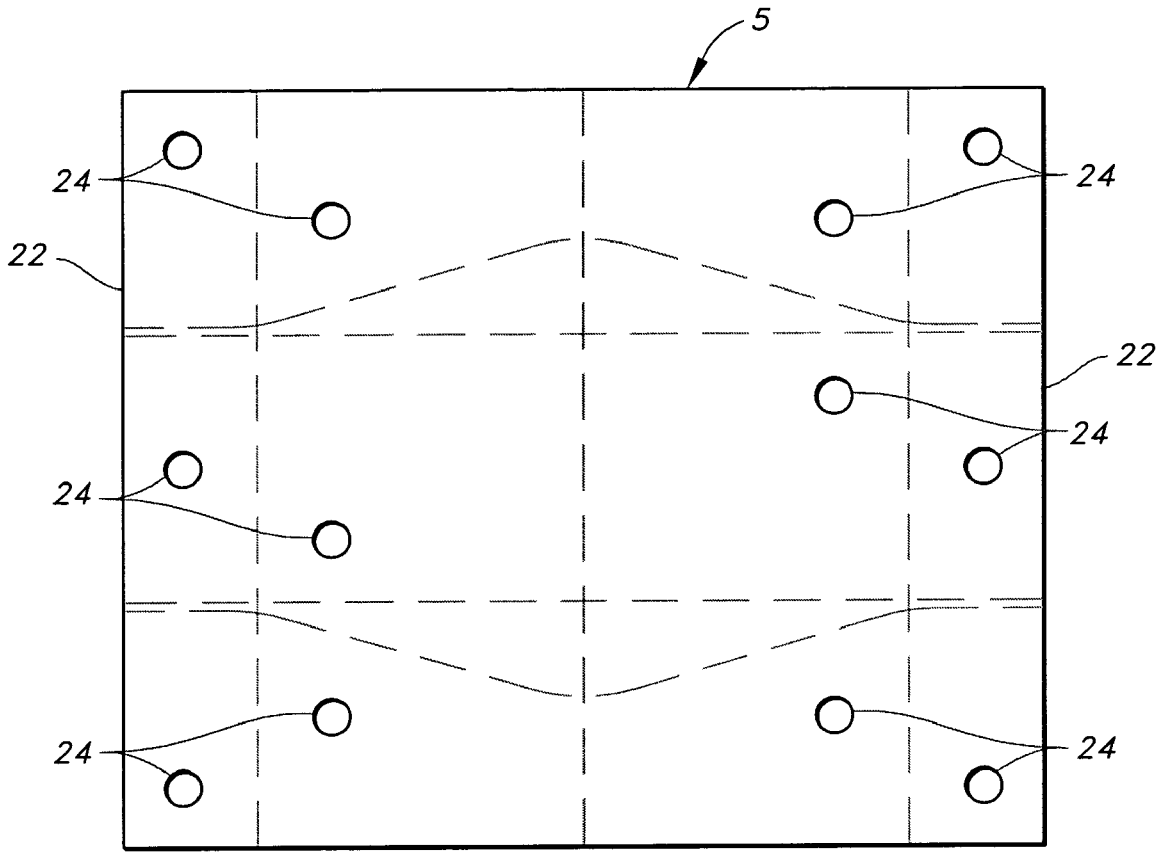
FIG. 16 is a top plan view of a sheet metal blank prior to bending from which a sheet metal connector formed according to the present invention is formed, showing where gussets will be formed and bends created in dashed outline.

The supporting structural member 2 has first and second adjacent sides 18 joined at an edge 19, the first side 18 interfacing with the interface side 10 of the fourth flange 9, the second side 18 interfacing with the interface side 10 of the third flange 8. The supported structural member 3 has first and second adjacent sides 20 joined at an edge 21, the first side 20 interfacing with the interface side 10 of the second flange 7, the second side 20 interfacing with the interface side 10 of the first flange 6. The edges 19 and 21 can be sharp edges, as shown in FIG. 3, or they can be rounded or otherwise blunted edges, as shown in FIG. 4.

The first side 18 of the supporting structural member 2 is fastened to the interface side 10 of the fourth flange 9. The second side 18 of the supporting structural member 2 is fastened to the interface side 10 of the third flange 8. The first side 20 of the supported structural member 3 is fastened to the interface side 10 of the second flange 7. The second side 20 of the supported structural member 3 is fastened to the interface side 10 of the first flange 6.

In the most preferred embodiment, the supporting and supported structural members 2 and 3 are hollow metal members, preferably steel, and the preferred fastening means are screws that penetrate one or two opposed walls of the hollow metal members. The hollow metal members can be round in cross-section, so that there are no parallel walls, but the interface with the connector flanges would then be imperfect, so this is not preferred. In an alternate embodiment, one or both of the structural members can be solid wood, metal, plastics, composites, or the like, and the preferred fasteners would be those best adapted for joining to the respective material. For wood, screws or nails could be used, and for solid metal bolts could be used. For plastics or composites, the connector could be attached using an adhesive, a method that could be used with any material so long as an appropriate adhesive is available.

Preferably, the supporting structural member 2 is a supporting truss 2, and the supported structural member 3 is a supported truss 3. The supporting truss 2 is preferably a girder truss 2, and the supported truss 3 is a hip truss 3. Alternatively, the supporting truss 2 is preferably a hip truss 2, and the supported truss 3 is a jack truss 3. Specifically, the supporting structural member 2 is preferably a vertical chord 27 in a supporting truss 2, and the supported structural member 3 is a vertical chord 27 in a supported truss 3, as the connector 5 of the present invention is designed to connect parallel structural members.

The first side 18 of the supported structural member 3 is preferably a side face 18 of the supported truss 3. The second side 18 of the supported structural member 3 is preferably an end face 18 of the supported truss 3. The first side 18 of the supporting structural member 2 is preferably a side face 18 of the supporting truss 2. The second side 18 of the supporting structural member 2 is preferably an interior face 18 of the supporting truss 2.

The first side of the first structural member is preferably a side face of the first truss, and the second side of the first structural member is an end face of the first truss. Preferably, the first side of the second structural member is a side face of the second truss, and the second side of the second structural member is an interior face of the second truss.

Preferably, the supporting truss 2 has metal chords 27. The supported truss 3 preferably also has metal chords 27. Although the connector of the present invention can be used to structural members of essentially any material, it is particularly adapted for joining hollow metal members, most preferably hollow sheet steel members. The most preferred use of the connector of the present invention is joining Nucon Steel Nutruss trusses.

Figure 2:
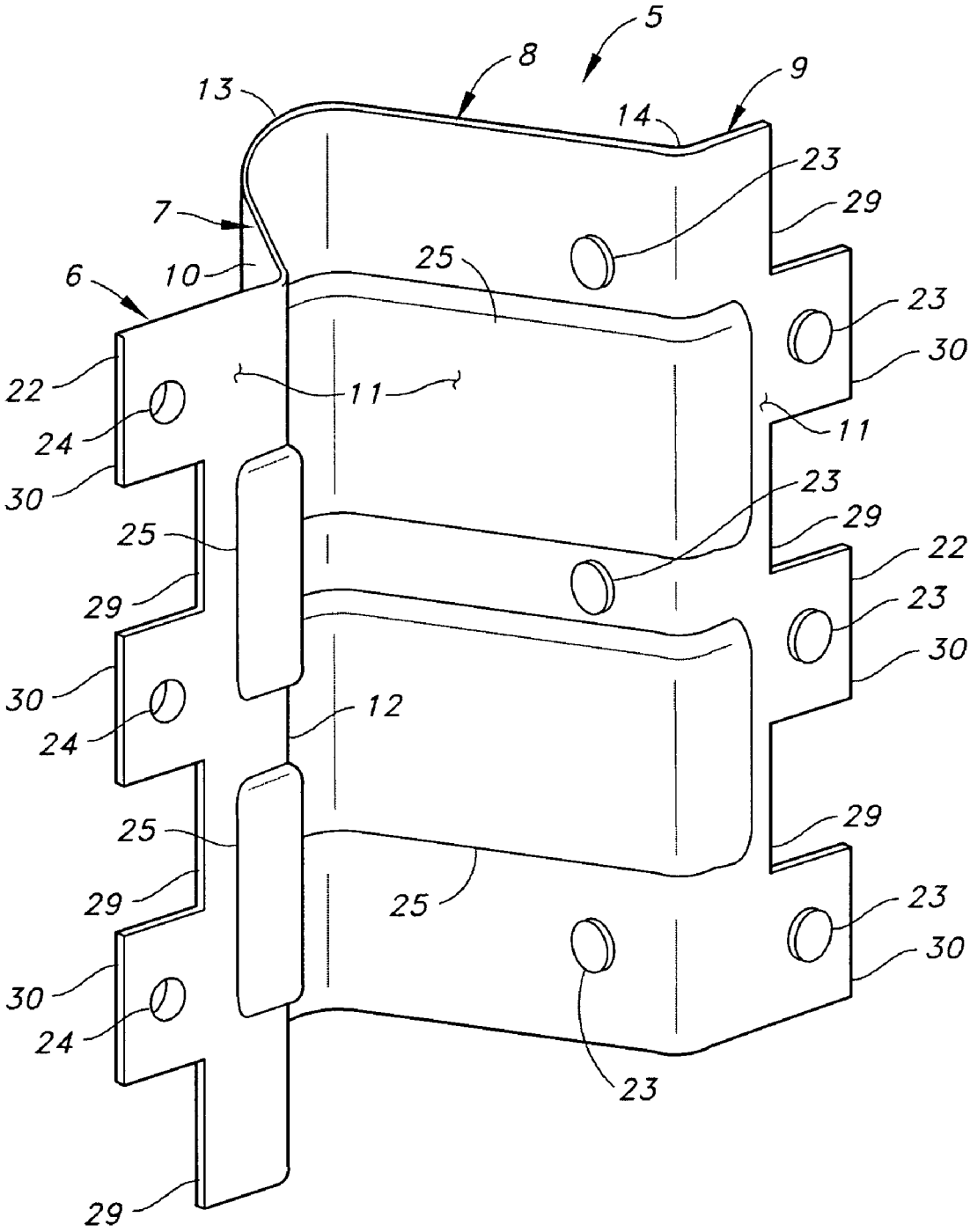
FIG. 2 is a perspective view of a skewed girder tie connector formed according to the present invention, with the open sides of the first, third and fourth flanges facing outward from the page while the open side of the second flange is occluded.

Preferably, the first side 18 of the supported structural member 3 is fastened to the interface side 18 of the first flange 6 with first mechanical fasteners 23. The second side 18 of the supported structural member 3 is preferably fastened to the interface side 18 of the second flange 7 with second mechanical fasteners 23. Preferably, the first side 18 of the supporting structural member 2 is fastened to the interface side 18 of the third flange 8 with third mechanical fasteners 23. The second side 18 of the supporting structural member 2 is preferably fastened to the interface side 18 of the fourth flange 9 with fourth mechanical fasteners 23, as shown in FIG. 2 with the heads of fasteners 23 located on the open side 11 of both the third flange 8 and fourth flange 9.

The first and second mechanical fasteners 23 preferably have elongate shanks 28, and the shanks 28 of the first mechanical fasteners 23 are substantially perpendicular to the shanks 28 of the second mechanical fasteners 23. Similarly, the shanks 28 of the first mechanical fasteners 23 preferably cross over the shanks 28 of the second mechanical fasteners 23 within the supporting structural member 2.

Preferably, the third and fourth mechanical fasteners 23 are self-drilling screws 23. More specifically, the third and fourth mechanical fasteners 23 are preferably self-drilling metal screws 23. Preferably, the first and second mechanical fasteners 23 are set screws 23, which go through opposite sides of the supported structural member 3. The first and second fasteners 23 preferably pass through the supported structural member 3.

In a first preferred embodiment, the connector 5 includes a first embossment 25 that crosses the second bend 13 from the second flange 7 to the third flange 8. The connector 5 preferably includes a second embossment 25 that crosses the second bend 13 from the second flange 7 to the third flange 8. Preferably, the first embossment 25 extends across the first bend 12 to the first flange 6 and across the third bend 14 to the fourth flange 9. The second embossment 25 preferably extends across the first bend 12 to the first flange 6 and across the third bend 14 to the fourth flange 9.

Figure 17:
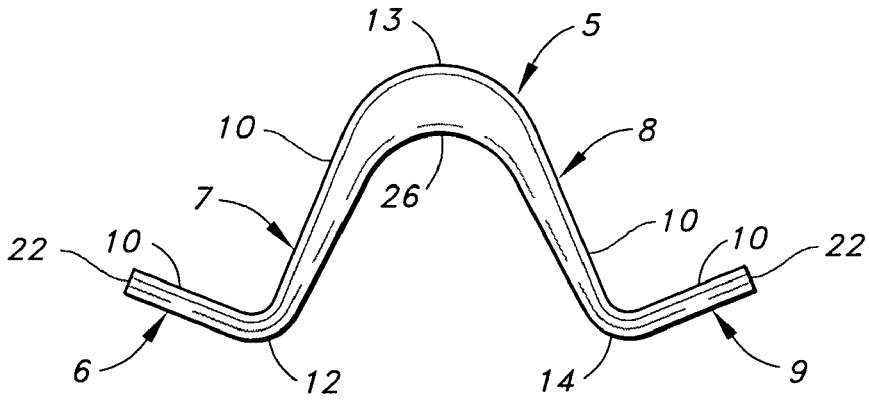
FIG. 17 is a top plan view of a gusseted connector formed according to the present invention.

In an alternate preferred embodiment, shown in FIGS. 17 and 17, the connector 5 includes a first gusset 26 that extends from the first bend 12 across the second flange 7, the second bend 13 and the third flange 8 to the third bend 14. The connector 5 includes a second gusset 26 that extends from the first bend 12 across the second flange 7, the second bend 13 and the third flange 8 to the third bend 14. The gussets 26 serve the same function as the embossments 25.

Preferably, the first flange 6 has an open edge 22 opposite the first bend 12, and the open edge 22 is formed with a series of indentations 29 and extensions 30. Preferably, the fourth flange 9 has an open edge 22 opposite the third bend 14, and the open edge 22 is formed with a series of indentations 29 and extensions 30. The extensions 30 are preferably formed with fastener openings 24. The extensions 30 allow a broader distribution of fasteners 23 while saving much of the material between the fastener openings 24.

I claim:

1. A connection (1) comprising:

a. a supporting structural member (2);

b. a generally horizontal, supported structural member (3), having a substantially vertical first end (4); wherein i. said supported structural member (3) is not parallel to said supporting structural member (2);

ii. said supported structural member (3) is not orthogonal to said supporting structural member (2);

iii. said first end (4) of said supported structural member (3) is connected to said supporting structural member (2) with a connector (5); and iv. said supported structural member (3) is supported by said supporting structural member (2);

c. said connector (5), connecting said first end (4) of said supported structural member (3) to said supporting structural member (2); said connector (5) having:

i. a first flange (6), having an interface side (10) interfacing with said supported structural member (3) and an open side (11);

ii. a second flange (7), having an interface side (10) interfacing with said supported structural structural member (3) and an open side (11), said second flange (7) being integrally attached to said first flange (6) at a first bend (12);

iii. a third flange (8), having an interface side (10) interfacing with said supporting structural member (2) and an open side (11), said third flange (8) being integrally attached to said second flange (7) at a second bend (13);

iv. a fourth flange (9), having an interface side (10) interfacing with said supporting structural member (2) and an open side (11), said fourth flange (9) being integrally attached to said third flange (8) at a third bend (14), wherein:

(a) said connector (5) has a first angle (15) between said interface side (10) of said first flange (6) and said interface side (10) of said second flange (7), and said first angle (15) is less than 180 degrees;

(b)said connector (5) has a second angle (16) between said open side (11) of said second flange (7) and said open side (11) of said third flange (8), said second angle (16) is less than 180 degrees; and (c) said connector (5) has a third angle (17) between said interface side (10) of said third flange (8) and said interface side (10) of said fourth flange (9), and said third angle (17) is less than 180 degrees; wherein:

d. said supporting structural member (2) has first and second adjacent sides (18) joined at an edge (19), said first of said adjacent sides (18) interfacing with said interface side (10) of said fourth flange (9), said second of said adjacent sides (18) interfacing with said interface side (10) of said third flange (8); and e. said supported structural member (3) has first and second adjacent sides (20) joined at an edge (21), said first of said adjacent sides (20) interfacing with said interface side (10) of said second flange (7), said second of said adjacent sides (20) interfacing with said interface side (10) of said first flange (6), wherein:

i. said first of said adjacent sides (18) of said supporting structural member (2) is fastened to said interface side (10) of said fourth flange (9);

ii. said second of said adjacent sides (18) of said supporting structural member (2) is fastened to said interface side (10) of said third flange (8);

iii. said first of said adjacent sides (20) of said supported structural member (3) is fastened to said interface side (10) of said second flange (7); and iv. said second of said adjacent sides (20) of said supported structural member (3) is fastened to said interface side (10) of said first flange (6).

2. The connection (1) of claim 1 wherein:

a. said supporting structural member (2) is a supporting truss (2); and b. said supported structural member (3) is a supported truss (3).

3. The connection (1) of claim 2 wherein:

a. said supporting truss (2) is a girder truss (2); and b. said supported truss (3) is a hip truss (3).

4. The connection (1) of claim 2 wherein:

a. said supporting truss (2) is a hip truss (2); and b. said supported truss (3) is a jack truss (3).

5. The connection (1) of claim 1 wherein:

a. said supporting structural member (2) is a vertical chord (27) in a supporting truss; and b. said supported structural member (3) is a vertical chord (27) in a supported truss.

6. The connection (1) of claim 2 wherein:

a. said first side (18) of said supported structural member (3) is a side face (18) of said supported truss (3);

b. said second side (18) of said supported structural member (3) is an end face (18) of said supported truss (3), c. said first side (18) of said supporting structural member (2) is a side face (18) of said supporting truss (2); and d. said second side (18) of said supporting structural member (2) is an interior face (18) of said supporting truss (2).

7. The connection (1) of claim 6 wherein:

a. said supporting truss (2) has metal chords (27).

8. The connection (1) of claim 7 wherein:

a. said supported truss (3) has metal chords (27).

9. The connection (1) of claim 1 wherein:

i. said first side (18) of said supported structural member (3) is fastened to said interface side (18) of said first flange (6) with first mechanical fasteners (23);

ii. said second side (18) of said supported structural member (3) is fastened to said interface side (18) of said second flange (7) with second mechanical fasteners (23);

iii. said first side (18) of said supporting structural member (2) is fastened to said interface side (18) of said third flange (8) with third mechanical fasteners (23); and iv. said second side (18) of said supporting structural member (2) is fastened to said interface side (18) of said fourth flange (9) with fourth mechanical fasteners (23).

10. The connection (1) of claim 9 wherein:

a. said first, second, third and fourth mechanical fasteners (23) are screws (23).

11. The connection (1) of claim 10 wherein:

a. said third and fourth mechanical fasteners (23) are self-drilling screws (23).

12. The connection (1) of claim 10 wherein:

a. said third and fourth mechanical fasteners (23) are self-drilling metal screws (23).

13. The connection (1) of claim 10 wherein:

a. said first and second mechanical fasteners (23) are set screws (23).

14. The connection (1) of claim 13 wherein:

a. said first and second mechanical fasteners (23) have elongate shanks (28);

b. said shanks (28) of said first mechanical fasteners (23) are substantially perpendicular to said shanks (28) of said second mechanical fasteners (23);

c. said shanks (28) of said first mechanical fasteners (23) cross over said shanks (28) of said second mechanical fasteners (23) within said supporting structural member (2).

15. The connection (1) of claim 14 wherein:

a. said first and second fasteners (23) pass through said supported structural member (3).

16. The connection (1) of claim 1 wherein:

a. said connector (5) includes a first embossment (25) that crosses said second bend (13) from said second flange (7) to said third flange (8).

17. The connection (1) of claim 16 wherein:

a. said connector (5) includes a second embossment (25) that crosses said second bend (13) from said second flange (7) to said third flange (8).

18. The connection (1) of claim 16 wherein:

a. said first embossment (25) extends across said first bend (12) to said first flange (6) and across said third bend (14) to said fourth flange (9).

19. The connection (1) of claim 17 wherein:

a. said second embossment (25) extends across said first bend (12) to said first flange (6) and across said third bend (14) to said fourth flange (9).

20. The connection (1) of claim 1 wherein:

a. said connector (5) includes a first gusset (26) that extends from said first bend (12) across said second flange (7), said second bend (13) and said third flange (8) to said third bend (14).

21. The connection (1) of claim 20 wherein:

a. said connector (5) includes a second gusset (26) that extends from said first bend (12) across said second flange (7), said second bend (13) and said third flange (8) to said third bend (14).

22. The connection (1) of claim 1 wherein:

a. said first flange (6) has an open edge (22) opposite said first bend (12), and said open edge (22) is formed with a series of indentations (29) and extensions (30); and b. said fourth flange (9) has an open edge (22) opposite said third bend (14), and said open edge (22) is formed with a series of indentations (29) and extensions (30).

23. The connection (1) of claim 22 wherein:

a. said extensions (30) are formed with fastener openings (24).

* * * * *